US012599217B2

(12) United States Patent
Zheng et al.

(10) Patent No.: US 12,599,217 B2
(45) Date of Patent: Apr. 14, 2026

(54) COSMETIC CONTAINER FOR MIXING AND DISPENSING TWO PRODUCTS

(71) Applicant: APR Beauty Group Inc, Toronto (CA)

(72) Inventors: Min-Yan Zheng, Richmond Hill (CA); Feng-Ying Fu, Markham (CA); Jun Shen, Lighthouse Point, FL (US)

(73) Assignee: APR Beauty Group Inc., Richmond Hill (CA)

( * ) Notice: Subject to any disclaimer, the term of this patent is extended or adjusted under 35 U.S.C. 154(b) by 280 days.

(21) Appl. No.: 18/492,671

(22) Filed: Oct. 23, 2023

(65) Prior Publication Data

US 2025/0127277 A1 Apr. 24, 2025

(51) Int. Cl.

| | |
|---|---|
| ***A45D 34/04*** | (2006.01) |
| ***A45D 34/00*** | (2006.01) |
| ***A45D 40/24*** | (2006.01) |

(52) U.S. Cl.

CPC ..... *A45D 34/04* (2013.01); *A45D 34/00* (2013.01); *A45D 40/24* (2013.01);

(Continued)

(58) Field of Classification Search

CPC ..... A45D 34/04; A45D 2200/056; A45D 2200/058; A45D 34/00; A45D 2200/055;

(Continued)

(56) References Cited

U.S. PATENT DOCUMENTS 2,786,769 A * 3/1957 Greenspan ..... A61J 9/00 215/11.1
3,802,604 A * 4/1974 Morane ..... B65D 51/28 222/85

(Continued)

FOREIGN PATENT DOCUMENTS

FR 3100695 A1 * 3/2021 ..... B65D 25/082
KR 200423697 Y1 * 8/2006 ..... B65D 81/32

(Continued)

OTHER PUBLICATIONS

Lee (KR102214128) with machine translation to English (Year: 2021).*

(Continued)

*Primary Examiner* — Paul R Durand
*Assistant Examiner* — Michael C Patterson
(74) *Attorney, Agent, or Firm* — Jason L DeFrancesco

(57) ABSTRACT

A cosmetic container that enables a user to easily mix a first product and a second product, that are stored separately within the cosmetic container, with a simple twist of the dialer before the first use. The first product is in a first product container, while the second is in a second product container. The cosmetic container includes the first product container, the second product container, a pump dispenser, an outer cap, a seal cap, a piston, an elevator, and the dialer. The dialer encloses the second product container and, when rotated, moves the elevator, which in turn pushes the piston inside the second product container. The piston, with a central rod, creates an aperture in the seal cap for the second product to flow into the first product container. This process ensures easy mixing before dispensing by removing the outer cap and using the pump dispenser.

17 Claims, 10 Drawing Sheets

(52) U.S. Cl.
CPC .. *A45D 2200/055* (2013.01); *A45D 2200/056* (2013.01); *A45D 2200/058* (2013.01)

(58) Field of Classification Search
CPC ... A45D 40/24; B05B 11/0081; B05B 7/0408; B65D 81/325
USPC ..... 222/145.1, 145.5, 80–91, 390; 401/68, 401/172, 174
See application file for complete search history.

(56) References Cited

U.S. PATENT DOCUMENTS

| | | | | | |
|---|---|---|---|---|---|
| 4,651,899 | A * | 3/1987 | Pauls | B65D 81/32 | 222/402.1 |
| 5,143,259 | A * | 9/1992 | Williams | B67D 7/0238 | 222/389 |
| 5,692,644 | A * | 12/1997 | Gueret | B05B 11/0083 | 222/129 |
| 6,474,861 | B1 * | 11/2002 | De Laforcade | B65D 81/3211 | 215/DIG. 8 |
| 6,520,381 | B1 * | 2/2003 | Prestele | B05C 17/0133 | 222/137 |
| 6,655,525 | B2 * | 12/2003 | Song | B65D 81/3211 | 215/DIG. 8 |
| 6,910,573 | B2 * | 6/2005 | Deans | B65D 81/3211 | 222/129 |
| 7,192,212 | B2 * | 3/2007 | Gutberlet | A45D 40/02 | 401/172 |
| 8,025,168 | B2 * | 9/2011 | Bullard | A61J 9/00 | 215/11.1 |
| 9,381,480 | B2 * | 7/2016 | Kang | B01F 35/7139 | |
| 11,542,090 | B2 * | 1/2023 | Pidoux | A45D 34/00 | |
| 2014/0231464 | A1 * | 8/2014 | Cho | B05B 11/1052 | 222/256 |
| 2022/0169434 | A1 * | 6/2022 | Lee | B65D 81/3211 | |

FOREIGN PATENT DOCUMENTS

| | | | | | |
|---|---|---|---|---|---|
| KR | 101192716 | B1 * | 10/2012 | A45D 40/04 | |
| KR | 200468348 | Y1 * | 8/2013 | B65D 81/3261 | |
| KR | 200472282 | Y1 * | 4/2014 | B05B 11/029 | |
| KR | 101660033 | B1 * | 9/2016 | B65D 81/3211 | |
| KR | 20170110315 | A * | 10/2017 | A61Q 5/10 | |
| KR | 101879205 | B1 * | 7/2018 | B65D 81/325 | |
| KR | 102214128 | B1 * | 2/2021 | A45D 40/24 | |
| WO | WO-2019076921 | A1 * | 4/2019 | B65D 83/761 | |
| WO | WO-2019117387 | A1 * | 6/2019 | A45D 19/0066 | |

OTHER PUBLICATIONS

Seo (KR20170110315) with machine translation to English (Year: 2017).*

* cited by examiner

COSMETIC CONTAINER FOR MIXING AND DISPENSING TWO PRODUCTS

BACKGROUND

Field

The present disclosure generally relates to a cosmetic container for separately storing at least two different types of liquid products and for mixing two liquid products at the time of initial use, and then discharging the mixed products in a single pumping operation.

Description of the Related Art

In general, liquid or paste cosmetics, hereafter referred to as "liquid contents," are typically stored in cosmetic containers equipped with pump dispensers. Users dispense a specific amount of liquid content from the cosmetic container by repeatedly pressing a pump dispenser head thereof.

However, there is a recent trend towards mixed-type cosmetics that offer multiple effects in a single product. These products may combine a liquid base component with other ingredients like powders or specific-effect liquids (e.g., vitamins or whitening agents). To maintain the effectiveness of such functional cosmetics and prevent deterioration during distribution, the mixing of the base component and additional ingredients is often done by consumers just before using the product. Consequently, there is a growing need for dual cosmetic containers capable of blending and dispensing multiple cosmetic products simultaneously.

Such a dual cosmetic container allows users to mix and use various cosmetics with differing raw materials, each with its unique shelf life. This ensures an extended overall shelf life and maximizes the efficacy of the mixed cosmetics.

U.S. Pat. No. 5,692,644A discloses a container for separately storing at least two products, mixing those products and for dispensing the mixture includes a first reservoir for liquid and a second cylindrical reservoir for powder. The second reservoir has a mouth that is contiguous with the first reservoir. A movable wall blocks the mouth of the second reservoir. A cylindrical part is movable from a position outside the second reservoir through the second reservoir and into the first reservoir after penetrating the mouth of the first reservoir by displacing the movable wall to thereby displace the powder into the first reservoir.

It is the object of the present disclosure to provide a cosmetic container with a cosmetic mixing function that is easy to operate, and has a simple and cost-effective construction.

SUMMARY

Accordingly, there is provided a cosmetic container that house two distinct cosmetic products within separate compartments, thereby facilitating user-driven mixing. This cosmetic container simplifies the blending process, enabling users to mix the two cosmetic products with ease through the straightforward rotation of a dialer.

According to an aspect of the present disclosure, the cosmetic container is configured to dispense a fluid product such as a liquid or any other fluid like product, according to a preferred embodiment of the present disclosure. The product can be more viscous than water or, optionally, even pasty. The cosmetic container according to the present disclosure is used for mixing two different types of liquid products at the time of initial use and then discharging the mixed contents in a single pumping operation. More particularly, the cosmetic container is configured for mixing a first product with a second product. The first product and the second product are liquid products. The first product is contained in a first product container, and a pump dispenser fastened to a neck formed at an upper end of the first product container. An open lower end of the first product container is attached to a second product container in a sealing manner. The second product is housed in a reservoir cavity of the second product container.

According to an aspect of the present disclosure, the cosmetic container comprises the first product container, the second product container, a pump dispenser, an outer cap, a seal cap, a piston, an elevator and a dialer. The cosmetic container allows a user to easily mix the first and the second products within the cosmetic container before the first use, with a simple twist of the dialer. The dialer is designed to rotate around and enclose the second product container. Meanwhile, the elevator is securely threaded into a lower portion of the second product container, situated beneath the reservoir cavity of the second product container. Within this reservoir cavity, the piston is slidably positioned, below the second product. When the dialer is turned, it initiates an upward movement of the elevator, which, in turn, exerts pressure on the piston located inside the second product container. As the piston ascends towards an upper end of the second product container, a central rod, located on the piston's upper side, punctures a breakable region of the seal cap that seals the upper section of the second product container. Consequently, the second product contained in the second product container is expelled into the first product container.

In a preferred embodiment, the second product container has a generally cylindrical shape along a main axis of the cosmetic container, and which is tightly and sealingly mounted on the lower end of the first product container. The first product container has a cylindrical sidewall with an empty inside to hold the first product, and a neck with a thread is provided at a top portion thereof to mount the pump dispenser. In addition, a lower part of the cylindrical sidewall of the first product container is open and has a large diameter part having an expanded inner diameter while forming a stepped jaw so that the second product container can be attached inside the opened lower part. Preferably, an inner surface of lower part of the cylindrical sidewall of the first product container includes a locking groove that receives a corresponding second locking protrusion formed on an outer surface of the second product container. The circumferential dimensions of an upper portion of the outer sidewall of second product container are complementary to those of an inner periphery of a lower portion of the first product container such that the upper portion of the outer sidewall of the second product container is sealingly disposed inside the first product container.

According to an aspect of the present disclosure, the second product container includes at least one reservoir sidewall defining the reservoir cavity for storing the second product. The second product container includes an open upper end formed by an upper end of the reservoir sidewall. At the lower end of the reservoir cavity, the reservoir sidewall includes a transversely extending annular ring wall, which serves to outline the lower boundary of the reservoir cavity. Moreover, a cylindrical skirt extends downward in the axial direction from an inner edge of this annular ring wall. This cylindrical skirt also incorporates two opposing inner threads, situated at or near the upper section of the cylindrical skirt.

According to another aspect of the present disclosure, the second product container includes an outer sidewall located radially outwardly to the reservoir sidewall. An upper end of the outer sidewall is connected to the reservoir sidewall by a transverse shoulder wall positioned at a middle portion of the reservoir sidewall. A lower end of the outer sidewall defines an open lower end of the second product container.

According to yet another aspect of the present disclosure, the open upper end of the second product container, that is defined by the open upper end of the reservoir sidewall, is adapted to be sealed by an seal cap. Meanwhile, a lower portion of the outer sidewall along with the lower open end of the second product container is enclosed by the dialer. The dialer is rotatably connected to the outer sidewall of the second product container.

In another aspect of present disclosure, the second product is housed within the reservoir cavity, positioned above the piston, while the top opening of the reservoir cavity is sealed by the seal cap. This seal cap comprises a top wall and a sidewall that extends downward from the top wall. A breakable region is incorporated into the top wall, which can be separated from the rest of the top wall when subjected to sufficient pressure. This breakable region is created through an annular groove on the upper surface of the top wall. Furthermore, an inner surface of the sidewall of the seal cap features an annular locking groove. This locking groove on the seal cap accommodates a corresponding first locking protrusion located on the outer surface of the reservoir sidewall of the second product container, effectively coupling the seal cap to the second product container.

According to yet another aspect of the present disclosure, the second product container accommodates the elevator in a manner where the elevator effectively seals the lower opening of the reservoir cavity. The elevator is threaded engagement to the cylindrical skirt of the second product container by engaging the two opposed inner threads of the second cosmetic container with threads formed on an outer surface of the elevator. These inner threads of the second product container are protruded threads, while the threads on the elevator are grooved threads.

Further, the elevator comprises a transverse top wall and a lower cylindrical sidewall extending downwardly from a lower surface of the transverse top wall. A connecting skirt extends upwardly from an upper surface of the transverse top wall and is located centrally on the transverse top wall. The lower cylindrical sidewall further includes a closed upper end and an open lower end opposed to the upper end thereof. Together, the top wall, the open lower end and the lower cylindrical side wall of the elevator create an internal cavity within the elevator. The outer surface of the lower cylindrical sidewall of the elevator has threads formed thereon. The transverse top wall includes an annular flange that extends radially outwards as a radial extension of the transverse top wall.

Furthermore, when the elevator is a non-extended and initial state, in the second product container, the annular flange of the transverse top wall of the elevator makes contact with the annular ring wall of the second product container. This contact effectively closes the opening of the reservoir cavity. In this state, the connecting skirt of the elevator extends into the reservoir cavity of the second product container, and the lower cylindrical sidewall threadedly engages with the inner surface of the cylindrical skirt through corresponding threads.

According to an aspect of the present disclosure, the threads of the elevator are grooved threads that are provided with stopper protrusions at both ends thereof. These stopper protrusions mark the limits of the elevator's movement, defining the retracted and fully extended positions. When the threads of the second product container is abutted against the stopper protrusion located at upper end of the threads of the elevator, is prevented from ascending (advancing) any further. When the threads of the second product container is abutted against the stopper protrusion located at lower ends of the threads of the elevator, the elevator is prevented from descending any further.

According to yet another aspect of the present disclosure, the dialer includes a sidewall having an open upper end and a bottom end closed by a bottom wall. The dialer includes an inner column coaxially arranged with the dialer and integrally formed with dialer. The inner column extending in an axial upward direction from on an inner surface of the bottom wall. The dialer is rotatably coupled to the second product container and moves the elevator by its rotation. Furthermore, an outer diameter of the dialer's sidewall matches that of the first product container, which ensures a smooth, seamless appearance on the outer surface of the cosmetic container. This design choice eliminates the need for any stepped portions or irregularities in the container's external appearance.

According to yet another aspect of the present disclosure, an annular locking groove is formed at an inner surface of the sidewall of the dialer. A third locking protrusion is formed at the outer surface of the outer sidewall of the second product container. The annular locking groove of the dialer receives the third locking protrusion of the second product container. Due to this, the dialer can rotate with respect to the second product container without being separated from the second product container.

Further, a receiving cavity is formed between the sidewall of the dialer and the inner column. The receiving cavity is configured to accommodate a lower portion of the second product container. When the lower portion of the second product container is inserted into the dialer, the outer sidewall and the cylindrical skirt is housed within the receiving cavity of the dialer. The inner column of the dialer, the lower cylindrical sidewall of the elevator, and the cylindrical skirt of the second product container are coaxially sleeved sequentially from inside out.

According to yet another aspect of the present disclosure, the piston is positioned to move within the reservoir cavity of the second product container. When the need arises to expel the second product from the reservoir cavity, the piston is moved axially in the direction of the upper end of the second product container. The piston is movable, for example, by means of the elevator that pushes the piston in an upward direction. The elevator is particularly designed so that the piston lies on top of the elevator. The piston is moved from the lower end of the reservoir cavity in the direction of the upper end of the reservoir cavity with the aid of the elevator when the second product is needed to be expelled out from the second product container for mixing with the first product.

Furthermore, the piston comprises a piston body and two piston lips, situated around the outer periphery of the piston body. These two lips are designed to establish a secure and leak-tight sliding contact with the inner surface of the reservoir sidewall, thus forming a seal within the reservoir cavity. The piston is advantageously made as a single part. In addition, the piston includes a connecting annular sleeve that extends downwards from the piston body and is configured to securely connected to the connecting skirt of the elevator. Thus, when the elevator moves axially upwards in the reservoir cavity along with it the piston is also pushed to be moved in upward direction. Furthermore, the piston body includes a central rod coaxially located on the piston body and extending upward from the piston body. The central rod of the piston includes a slanted upper edge that is configured to exert force on the breakable region causing it to fracture and detach from the remaining section of the seal cap. As a result of this action, an aperture is created within the seal cap. This aperture serves as the conduit for enabling the discharge of the second product into the first product container for mixing with the first product.

The elevator is coupled with the dialer to convert the rotational motion of the dialer into a linear reciprocating motion. The inner column of the dialer has a no-circular cross-section and similarly the lower cylindrical sidewall of the elevator features an inner perimeter configured to match the non-circular cross-sectional shape of the inner column. In the preferred embodiment, the inner column of the dialer has a rectangular shape, characterized by two opposing flat sides and two opposing curved sides. The lower cylindrical sidewall of the elevator is mounted over the rectangular inner column of the dialer to prevent any relative rotational movement between the elevator and dialer during operation. Consequently, when in use, the elevator consistently moves relative to the dialer along the axial direction. The elevator thus can elevate inside the reservoir cavity in conjunction with the rotation of the dialer. That is, the elevator is coupled with the dialer to convert the rotational motion of the dialer into a linear reciprocating motion.

According to yet another aspect of the present disclosure, the pump dispenser has a support body threadedly mounted on the neck of the first product container. The support body includes a coupling part having threads a that engages with the threads a formed on outer surface of the neck of the first product container. The support body is configured to secure a pumping assembly that is disposed in neck of the first outer container. The pumping assembly includes a cylinder having a pressure chamber a formed therein to temporarily store the product from the first product container that is sucked therein through a suction tube secured to a lower end of the cylinder. The pump assembly further includes a hollow piston rod, a lower end of which is located in the cylinder and an upper end of which passes through the central portion of the support body. The hollow piston rod is configured to be moved/slide up and down. Further, there is provided a check valve that opens and closes an inlet formed at a bottom of the cylinder according to the pressure change in the pressure chamber. A dispensing head is fastened to an upper end of the hollow piston rod, and the dispensing head has a discharge port formed on one side thereof. A coil spring is provided between the piston rod and the support body for elastically supporting the piston rod upward together with the dispensing head. When dispensing head is pressed downwardly, the piston rod moves down to compress the coil spring, consequently, the pressure in the pressure chamber increases, and the product temporarily stored therein are transferred to the piston rod and is discharged to the outside through the discharge port of the dispensing head. When the external force pressing the dispensing head is removed, the piston rod rises again by the elastic support force of the coil spring and the check valve is opened. The product stored in the first product container is sucked again through the suction tube. It is well within the scope and ambit of present disclosure that various other types of dispensing mechanisms or other pump mechanisms known in the art can be used to dispense the product from the first product container.

Initially, prior to the first use of the cosmetic container in line with this disclosure, the first product is housed within the first product container, while the second product is stored within the second product container. Consequently, the first product and the second product remain segregated. To initiate the mixing of these two liquid products, the user rotates the dialer in relation to the first product container. This action results in the synchronous rotation of both the inner column and the elevator, driven by the dialer. Given that the second product container remains stationary relative to the first product container, the elevator, during its rotational motion, concurrently moves upward along the threads a of the second product container. As the elevator ascends, it exerts upward pressure on the piston, compelling it to move in an upward direction. As the piston rises, the central rod of the piston applies pressure, causing the rupture of the breakable region, thus creating an opening (aperture) within the seal cap. This aperture allows the second product to flow into the first product container, facilitating its mixture with the first product. The piston eventually reaches to its highest position, displacing the entire second product from the reservoir cavity into the first product container, and making contact with the inner surface of the seal cap.

Thereafter, the user can then shake the cosmetic container for uniformly mixing the first and second products. When the user removes the outer cap and presses the dispensing head of the pump dispenser, the first product and the second product that were mixed inside the first product container are discharged to the outside. In a preferred embodiment, the outer cap is removably coupled to the pump dispenser.

Additional advantages, features, characteristics and aspects of the present invention follow from the claims and the following description of a preferred embodiment with reference to the drawing.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
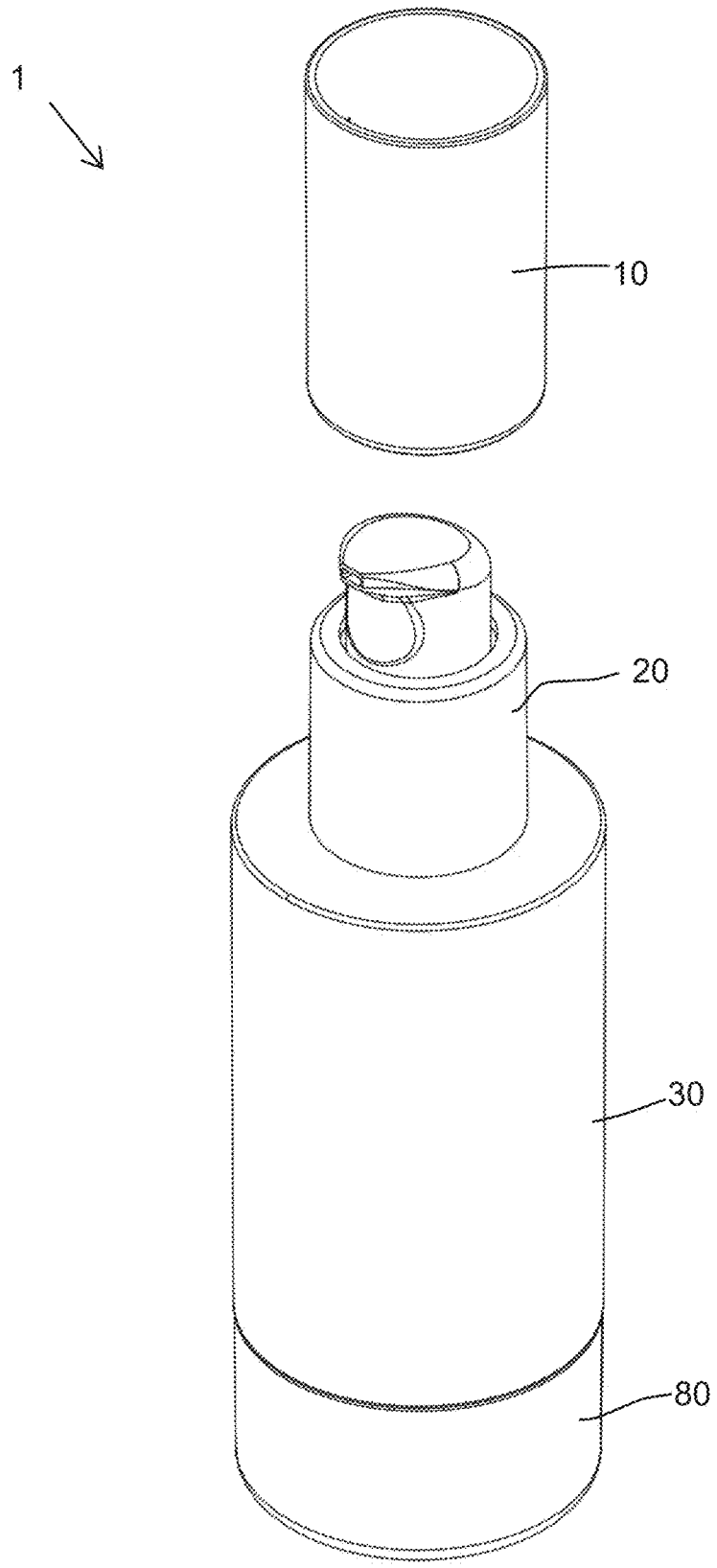
FIG. 1 illustrates a perspective view of a cosmetic container according to a preferred embodiment of the present disclosure, with an outer cap thereof shown in removed state.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered limited by the foregoing description.

The terms "comprise" (and any form of comprise, such as "comprises" and "comprising"), "have" (and any form of have, such as "has" and "having"), "contain" (and any form of contain, such as "contains" and "containing"), and "include" (and any form of include, such as "includes" and "including") are open-ended linking verbs. As a result, a system or method that "comprises," "has," "contains," or "includes" one or more elements possesses those one or more elements, but is not limited to possessing only those one or more elements or steps. Likewise, an element of a system or method that "comprises," "has," "contains," or "includes" one or more features possesses those one or more features, but is not limited to possessing only those one or more features. Furthermore, a structure that is configured in a certain way must be configured in at least that way, but also may be configured in a way or ways that are not specified.

Figure 2:
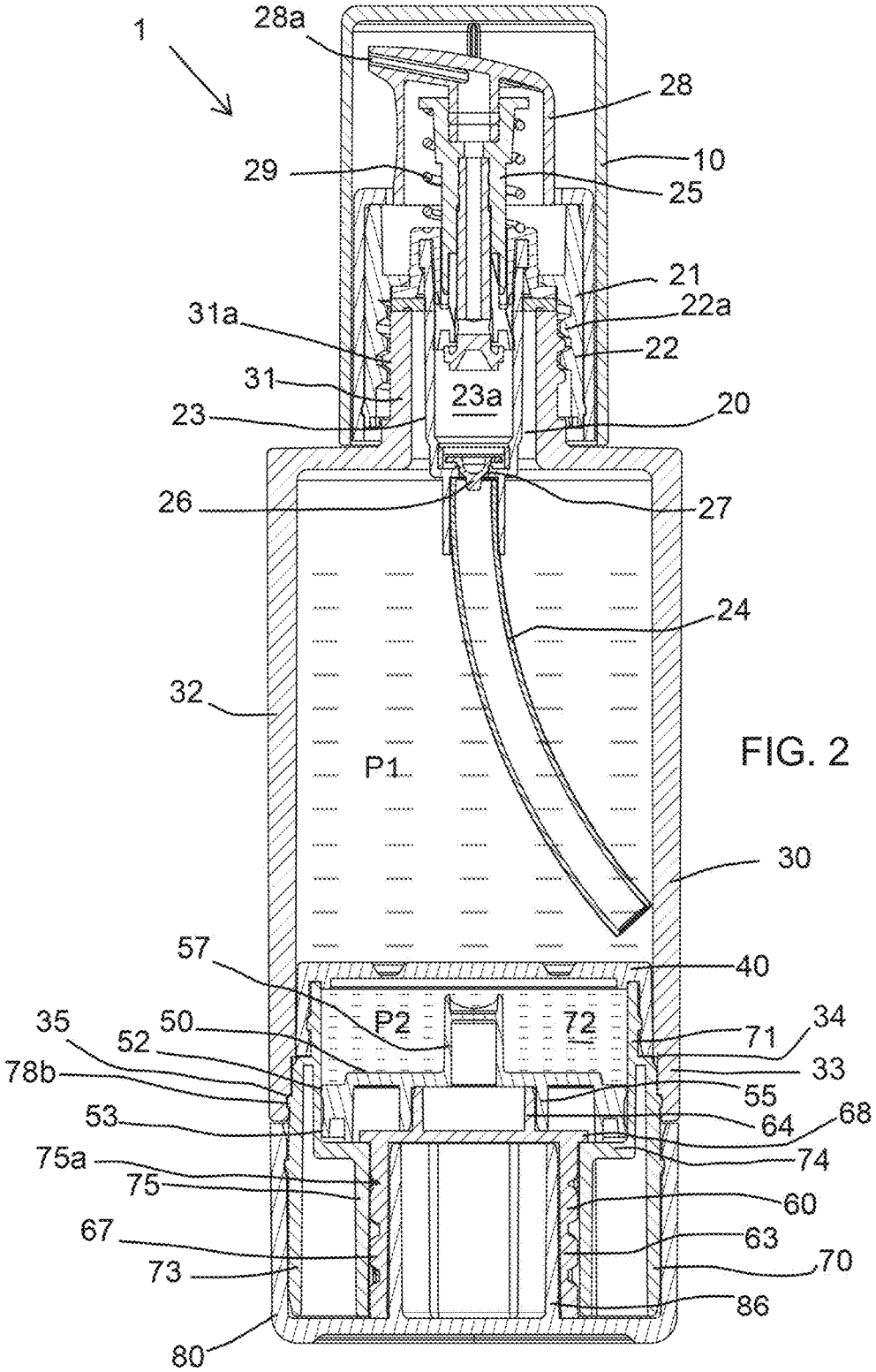
FIG. 2 illustrates a longitudinal cross-sectional view of the cosmetic container of FIG. 1 with a cap thereof shown attached to the cosmetic container.
Figure 3:
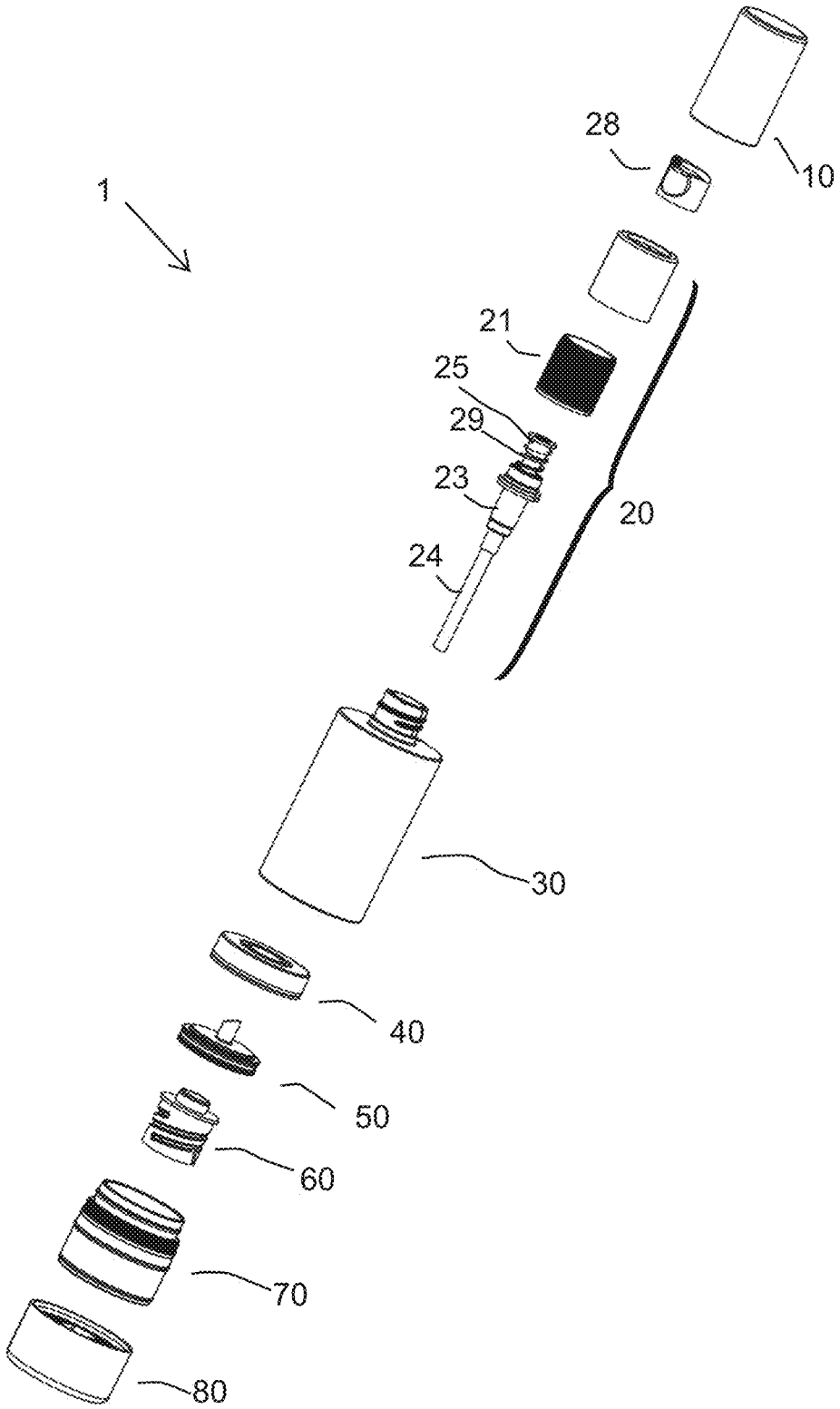
FIG. 3 illustrates an exploded view of the cosmetic container of FIG. 1.

FIGS. 1-8 show a cosmetic container 1 for dispensing a fluid product such as a liquid or any other fluid like product, according to a preferred embodiment of the present disclosure. The product can be more viscous than water or, optionally, even pasty. The cosmetic container 1 according to the present disclosure is used for evenly mixing two different types of liquid products at the time of initial use and then discharging the mixed contents in a single pumping operation. As shown in FIG. 2, the cosmetic container 1 is configured for mixing a first product P1 with a second product P2. The first product and the second product are liquid products. The first product P1 is contained in a first product container 30, and a pump dispenser 20 fastened to a neck 31 formed at an upper end of the first product container 30. The second product P2 is housed in a second product container 70.

The cosmetic container 1 comprises the first product container 30, the second product container 70, a pump dispenser 20, an outer cap 10, a seal cap 40, a piston 50, an elevator 60 and a dialer 80. An open lower end of the first product container 30 is attached to a second product container 70 in a sealing manner. The cosmetic container 1 allows a user to easily mix the first and the second products within the cosmetic container 1 before the first use, with a simple twist of the dialer 80. The dialer 80 is designed to rotate around and enclose the second product container 70. Meanwhile, the elevator 60 is securely threaded into a lower portion of the second product container 70, situated beneath its reservoir cavity 72. The piston 50 is slidably positioned within the reservoir cavity 72 beneath the second product P2. When the dialer 80 is rotated relative to the first and the second product containers 30, 70, the dialer 80 initiates an upward movement of the elevator 60, which, in turn, exerts pressure on the piston 50 located inside the second product container 30. As the piston 50 ascends towards an upper end of the second product container 70, a central rod 57, located on the piston's upper side, punctures a breakable region 43 of the seal cap 40 that seals the upper section of the second product container 70. Consequently, the second product P2 contained in the second product container 70 is expelled into the first product container 30.

In the present embodiment, the second product container 70 has a generally cylindrical shape along a main axis of the cosmetic container 1, and which is tightly and sealingly mounted on the lower end of the first product container 30. The first product container 30 has a cylindrical sidewall 32 with an empty inside to hold the first product P1, and a neck 31 with a male thread 31*a* is provided at a top portion thereof to mount the pump dispenser 20. In addition, a lower part of the cylindrical sidewall 32 of the first product container 30 is open and has a part 33 having an expanded inner diameter while forming a stepped jaw 34 so that the second product container 70 can be attached inside the opened lower part. As shown in FIG. 2, an inner surface of lower part of the cylindrical sidewall 32 of the first product container 30 includes a locking groove 35 that receives a corresponding second locking protrusion 78*b* formed on an outer surface of the second product container 70.

Figure 4:
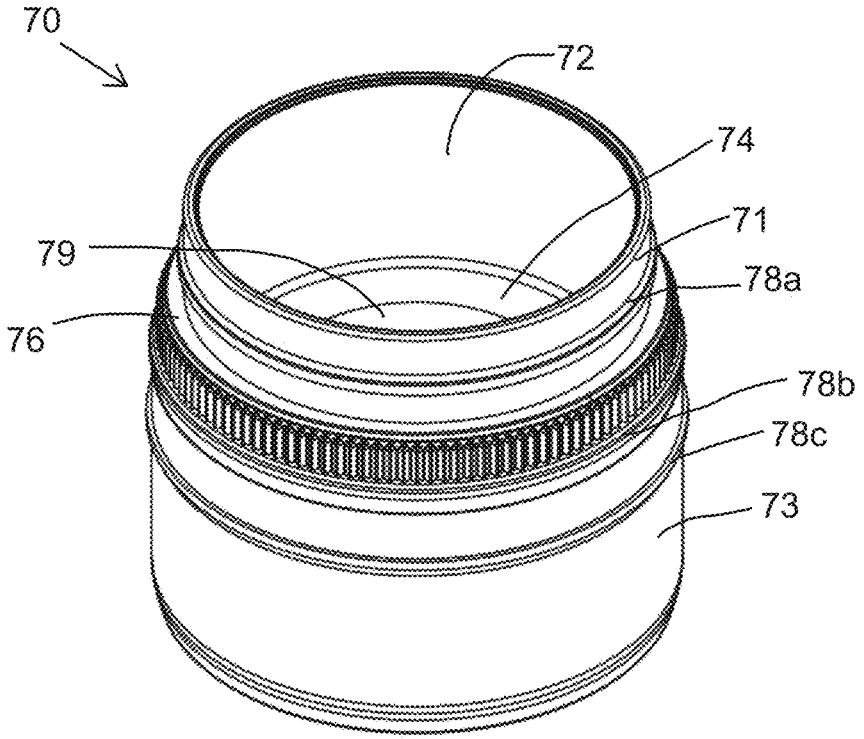
FIG. 4 illustrates a perspective view of a second product container of the cosmetic container of FIG. 1.
Figure 5:
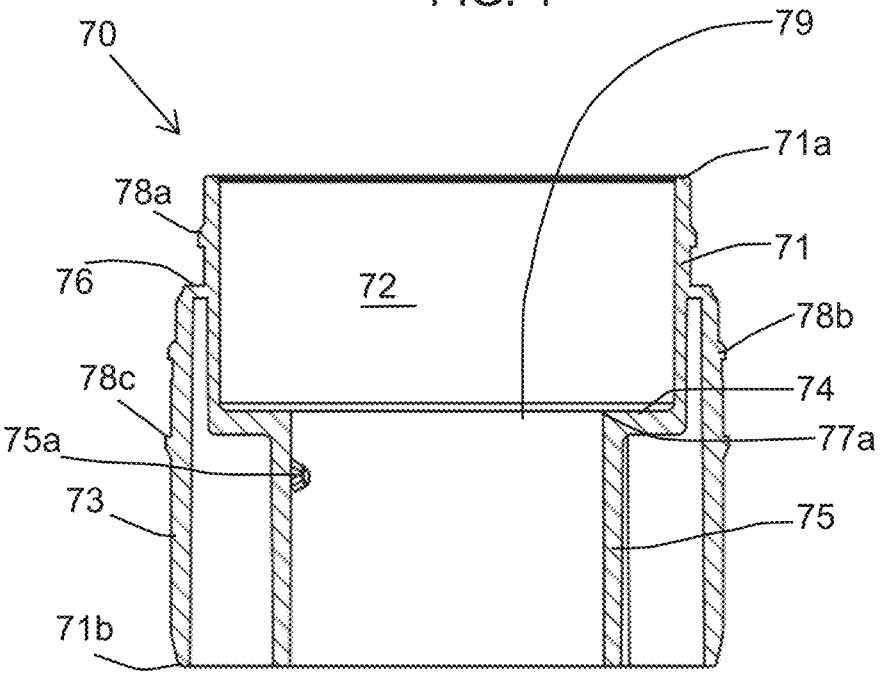
FIG. 5 illustrates a longitudinal cross-sectional view of the second product container of FIG. 4.

As shown in FIGS. 4 and 5, the second product container 70 includes at least one reservoir sidewall 71 defining the reservoir cavity 72 for storing the second product P2. The second product container 70 includes an open upper end 71*a* defined by an upper end of the reservoir sidewall 71. The reservoir sidewall 71 includes transversally extending annular ring wall 74 located at a lower end of the reservoir cavity 72. The annular ring wall 74 delimiting a lower opening 79 of the reservoir cavity 72. Further, a cylindrical skirt 75 depends from an inner edge 77*a* of the annular ring wall 74 in an axial downward direction. The cylindrical skirt 75 also comprises two opposed inner threads 75*a* located at or adjacent to an upper end of the cylindrical skirt 75.

The second product container 70 includes an outer sidewall 73 located radially outwardly to the reservoir sidewall 71. An upper end of the outer sidewall 73 is connected to the reservoir sidewall 71 by a transverse shoulder wall 76 positioned at a middle portion of the reservoir sidewall 71. A lower end of the outer sidewall 73 defines an open lower end 71*b* of the second product container 70.

Referring to FIG. 2, the open upper end 71*a* of the second product container 70 is defined by the open upper end of the reservoir sidewall 71 is adapted to be sealed by an seal cap 40. A lower portion of the outer sidewall 73 and the lower open end 71*b* of the second product container 70 is sleeved by the dialer 80. The dialer 80 is rotatably connected to the outer sidewall 73 of the second product container 70.

Figure 6:
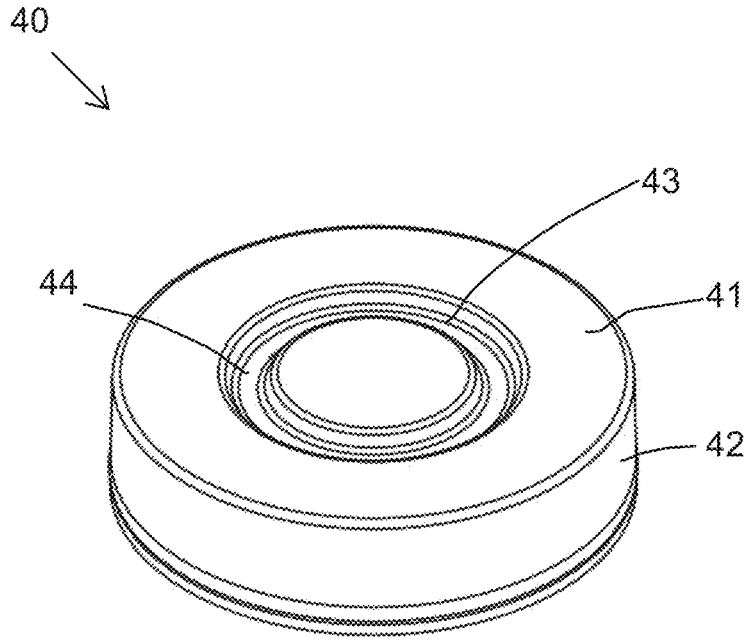
FIG. 6 illustrates a perspective view of a seal cap of the cosmetic container of FIG. 2.
Figure 7:
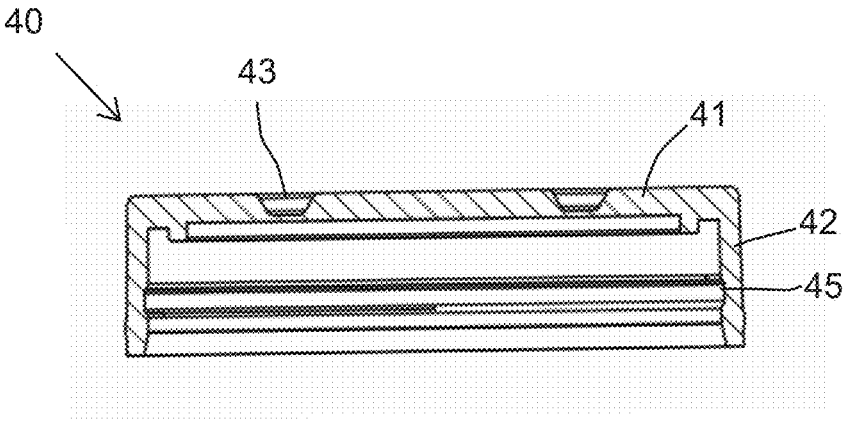
FIG. 7 illustrates a longitudinal cross-sectional view of the seal cap of FIG. 6.

Referring to FIG. 2, the second product P2 is accommodated in the reservoir cavity 72 on an upper side of the piston 50 and the open upper end 71*a* of the reservoir cavity 32 is closed by the seal cap 40. As shown in FIGS. 6 and 7, the seal cap 40 includes a top wall 41 and a sidewall 42 depending from the top wall 41. The top wall 41 includes breakable region 43 of a small thickness than a thickness of rest of the top wall 41. The breakable region 43 is an annular groove 44 formed on an upper surface of the top wall 41. In addition, the sidewall 42 of the seal cap 40 includes an annular locking groove 45 formed at an inner surface thereof. The annular locking groove 45 of the seal cap 40 receives a corresponding first locking protrusion 78*a* formed on an outer surface of the reservoir sidewall 71 of the second product container 70 for coupling the second reservoir 70 to the seal cap 40.

The circumferential dimensions of an upper portion of the outer sidewall 73 of second product container 70 are complementary to those of an inner periphery of a lower portion of the first product container 30 such that the upper portion of the outer sidewall 73 of the second product container 70 is sealingly disposed inside the first product container 30.

As shown in FIG. 2, the second product container 70 houses the elevator 60 such that the elevator 60 closes the lower opening 79 of the reservoir cavity 72. The elevator 60 is threaded engagement to the cylindrical skirt 75 of the second product container 70 by engaging the two opposed inner threads 75*a* of the second product container 70 with threads 67 formed on an outer surface of the elevator 60. The inner threads 75*a* of the second product container 70 are protruded threads, whereas the threads 67 of the elevator are grooved threads.

Figure 8A:
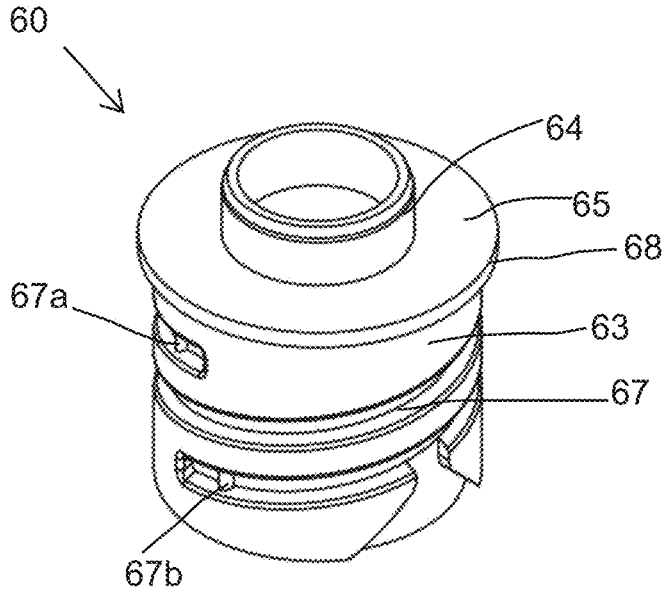
FIG. 8A illustrates a top perspective view of an elevator of the cosmetic container of FIG. 2.
Figure 9:
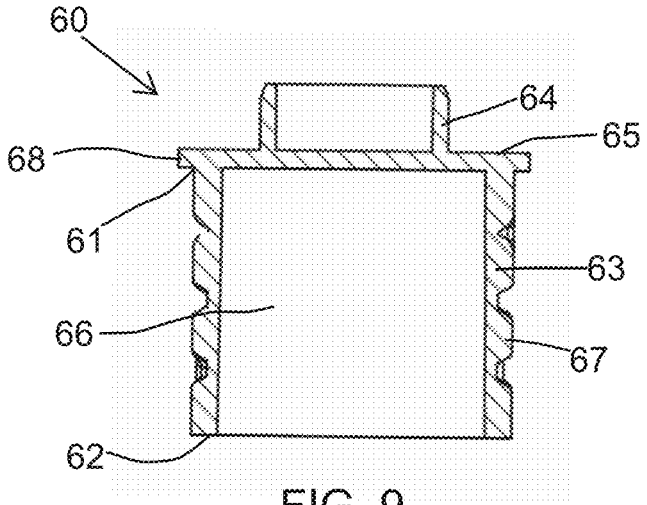
FIG. 9 illustrates a longitudinal cross-sectional view of the elevator of FIG. 8A.

Referring to FIGS. 8 and 9, the elevator 60 comprises a transverse top wall 65 and a lower cylindrical sidewall 63 extending downwardly from a lower surface of the transverse top wall 65. A connecting skirt 64 extends upwardly from an upper surface of the transverse top wall 65 and is located centrally on the transverse top wall 65. The lower cylindrical sidewall 63 further includes a closed upper end 61 and an open lower end 62 opposed to the upper end 61 thereof. The top wall 65, the open lower end 62 and the lower cylindrical side wall 63 of the elevator 60 define an internal cavity 66. The outer surface of the lower cylindrical sidewall 63 of the elevator 60 has threads 67 formed thereon. The transverse top wall 65 includes an annular flange 68 that extends radially outwards as a radial extension of the transverse top wall 65.

Referring to FIG. 2, when the elevator 60 is a non-extended and initial state, in the second product container 70, the annular flange 68 of the transverse top wall 65 of the elevator 60 abut against the annular ring wall 74 of the second product container 70 and closes the opening of the reservoir cavity 72. In this state, the connecting skirt 64 of the elevator 60 projects into the reservoir cavity 72 of the second product container 70 and the lower cylindrical sidewall 63 threadedly engaged with the inner surface of the cylindrical skirt 75 through corresponding threads 67, 75*a*.

The threads 67 of the elevator 60 are grooved threads that is provided with stopper protrusions 67*a*, 67*b* at both ends thereof. The stopper protrusions 67*a* define retracted and an advanced extremities of the elevator 60. When the threads 75*a* of the second product container 70 is abutted against the stopper protrusion 67*a* located at upper ends of the threads 67 of the elevator 60, is prevented from ascending (advancing) any further. When the threads 75*a* of the second product container 70 is abutted against the stopper protrusion 67*b* located at lower ends of the threads 67 of the elevator 60, the elevator 60 is prevented from descending any further.

Figure 10:
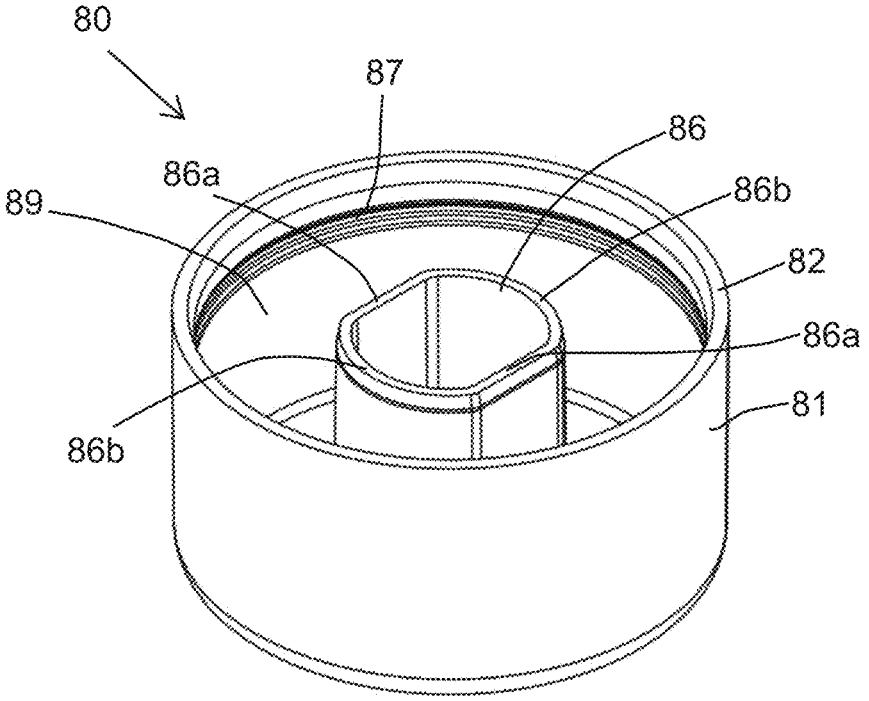
FIG. 10 illustrates a perspective view of a dialer of the cosmetic container of FIG. 2.
Figure 11:
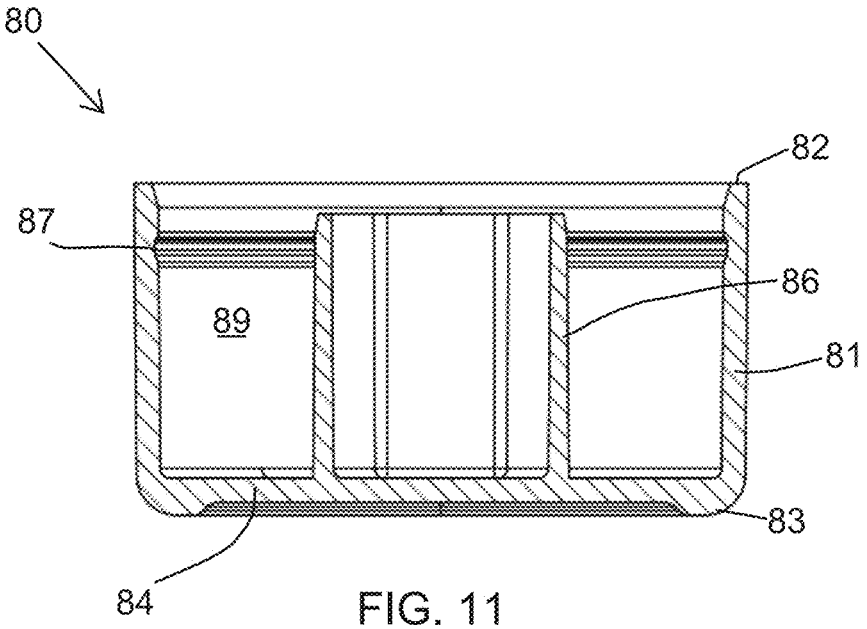
FIG. 11 illustrates a longitudinal cross-sectional view of the dialer FIG. 9.

Referring to FIGS. 10 and 11, the dialer 80 includes a sidewall 81 having an open upper end 82 and a bottom end 83 closed by a bottom wall 84. The dialer 80 includes an inner column 86 coaxially arranged with the dialer 80 and integrally formed with dialer 80. The inner column 86 extending in an axial upward direction from on an inner surface of the bottom wall 84. The dialer 80 is rotatably coupled to the second product container 70 and moves the elevator 60 by its rotation. An outer diameter of the sidewall 81 is be formed to be the same as an outer diameter of the first product container 30 and thus, a stepped portion is not be formed on the outer surface of the mixing cosmetic container 1 and may be formed smoothly.

An annular locking groove 87 is formed at an inner surface of the sidewall 81 of the dialer 80. A third locking protrusion 78*c* is formed at the outer surface of the outer sidewall 73 of the second product container 70. The annular locking groove 87 of the dialer 80 receives the third locking protrusion 78*c* of the second product container 70. Due to this, the dialer 80 can rotate with respect to the second product container 70 without being separated from the second product container 70.

A receiving cavity 89 is formed between the sidewall 81 of the dialer 80 and the inner column 86. The receiving cavity 89 is configured to receive a lower portion of the second product container 70, see FIG. 2. When the lower portion of the second product container 70 is received in the dialer 80, the outer sidewall 73 and the cylindrical skirt 75 is received within the receiving cavity 89 of the dialer 80. The inner column 86 of the dialer 80, the lower cylindrical sidewall 63 of the elevator 60, and the cylindrical skirt 75 of the second product container 70 are coaxially sleeved sequentially from inside out.

Referring to FIG. 2, the piston 50 is movably received in the reservoir cavity 72 of the second product container 70. The piston 50 is movable axially in the direction of the upper end of the second product container 70 when the second product in the reservoir cavity 72 should be expelled, as will be explained in more detail later. The piston 50 is movable, for example, by means of the elevator 60 that pushes the piston 50 in an upward direction. The elevator 60 is particularly designed so that the piston 50 lies on top of the elevator 60. The piston 50 is moved from the lower end of the reservoir cavity 72 in the direction of the upper end of the reservoir cavity 72 with the aid of the elevator 60 when the second product P2 should be expelled out from the second product container 70 for mixing with the first product P1.

Figure 12:
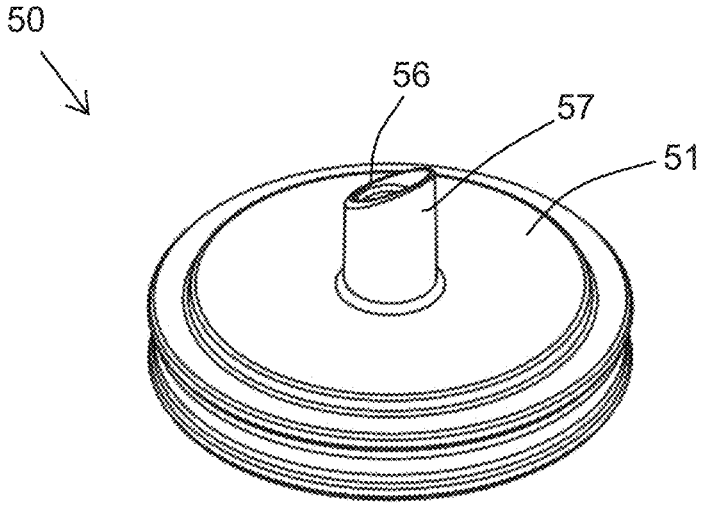
FIG. 12 illustrates a perspective view of a piston of the cosmetic container of FIG. 2.
Figure 13:
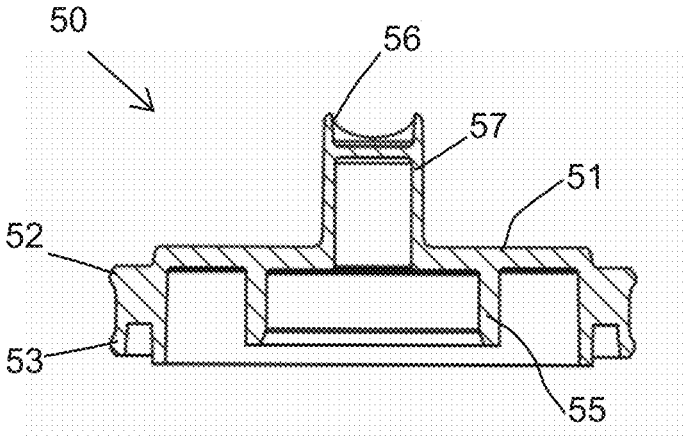
FIG. 13 illustrates a longitudinal cross-sectional view of the piston of FIG. 12.

Referring to FIGS. 12 and 13, the piston 50 has a piston body 51 and two piston lips 52 and 53 formed on the outer periphery of the piston body 51. The two lips 52 and 53 are configured to be in leak-tight sliding contact in the reservoir cavity 72 formed by an inner surface of the reservoir side wall 71, see FIG. 2. The piston 50 is advantageously made as a single part. The piston lips 52, 53 form a seal for the second product P2 by means of which it is prevented that the second product P2 is discharged from a lower end of the reservoir cavity 72. In addition, the piston 50 includes a connecting annular sleeve 55 that extends downwards from the piston body 51 and is configured to securely connected to the connecting skirt 64 of the elevator 60, refer FIG. 2. Thus, when the elevator 60 moves axially upwards in the reservoir cavity 72 along with it the piston 50 is also pushed to be moved in upward direction. Further, the piston body 51 includes a central rod 57 coaxially located on the piston body 51 and extending upward from the piston body 51. The central rod 57 of the piston 50 includes a slanted upper edge 56 that is configured to exert force on the breakable region 43 causing it to fracture and detach from the remaining section of the seal cap 40. As a result of this action, an aperture 46 is created within the seal cap 40. This aperture 46 serves as the conduit for enabling the discharge of the second product P2 into the first product container 30 for mixing with the first product P1.

Figure 8B:
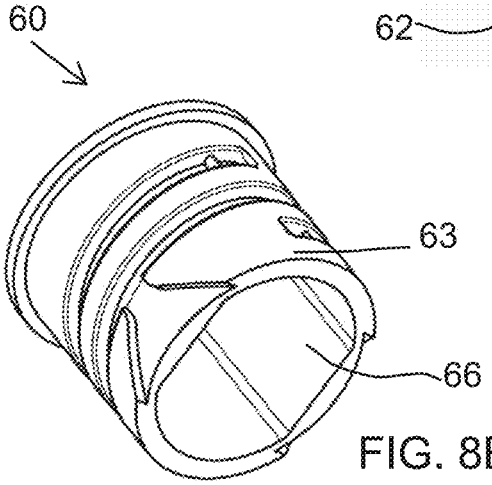
FIG. 8B illustrates a bottom perspective view of the elevator of FIG. 8A.

The elevator 60 is coupled with the dialer 80 to convert the rotational motion of the dialer 80 into a linear reciprocating motion. Referring to FIGS. 2, 8B, and 10, the inner column 86 of the dialer 80 has a no-circular cross-section and similarly the lower cylindrical sidewall 63 of the elevator 60 features an inner perimeter configured to match the non-circular cross-sectional shape of the inner column 86. In the illustrated embodiment, as shown in FIG. 10, the inner column 86 of the dialer 80 has a rectangular shape, characterized by two opposing flat sides 86*a* and two opposing curved sides 86*b*. The lower cylindrical sidewall 63 of the elevator 60 is mounted over the rectangular inner column 86 of the dialer 80 to prevent any relative rotational movement between the elevator 60 and dialer 80 during operation. Consequently, when in use, the elevator 60 consistently moves relative to the dialer 80 along the axial direction. The elevator 60 thus can elevates inside the reservoir cavity 72 in conjunction with the rotation of the dialer 80. That is, the elevator 60 is coupled with the dialer 80 to convert the rotational motion of the dialer 80 into a linear reciprocating motion.

The pump dispenser 20 has a support body 21 threadedly mounted on the neck 31 of the first product container 30. The support body 21 includes a coupling part 22 having threads 22*a* that engages with the threads 31*a* formed on outer surface of the neck 31 of the first product container 30. The support body 21 is configured to secure a pumping assembly that is disposed in neck 31 of the first outer container 30. The pumping assembly includes a cylinder 23 having a pressure chamber 23*a* formed therein to temporarily store the product from the first product container 30 that is sucked therein through a suction tube 24 secured to a lower end of the cylinder 23. The pump assembly further includes a hollow piston rod 25 a lower end of which is located in the cylinder 23 and an upper end of which passes through the central portion of the support body 21. The hollow piston rod 25 is configured to be moved/slide up and down. Further, there is provided a check valve 26 that opens and closes an inlet 27 formed at a bottom of the cylinder 23 according to the pressure change in the pressure chamber 23*a*. A dispensing head 28 is fastened to an upper end of the hollow piston rod 25, and the dispensing head 28 has a discharge port 28*a* formed on one side thereof. A coil spring 29 is provided between the piston rod 25 and the support body 21 for elastically supporting the piston rod 25 upward together with the dispensing head 28. When dispensing head is pressed downwardly, the piston rod 25 moves down to compress the coil spring 29, consequently, the pressure in the pressure chamber 23*a* increases, and the product temporarily stored therein are transferred to the piston rod 25 and is discharged to the outside through the discharge port 28*a* of the dispensing head 28. When the external force pressing the dispensing head 28 is removed, the piston rod 25 rises again by the elastic support force of the coil spring 29 and the check valve 26 is opened. The product stored in the first product container 30 is sucked again through the suction tube 24. It is well within the scope and ambit of present disclosure that various other types of dispensing mechanisms or other pump mechanisms known in the art can be used to dispense the product from the first product container 30.

Figure 14:
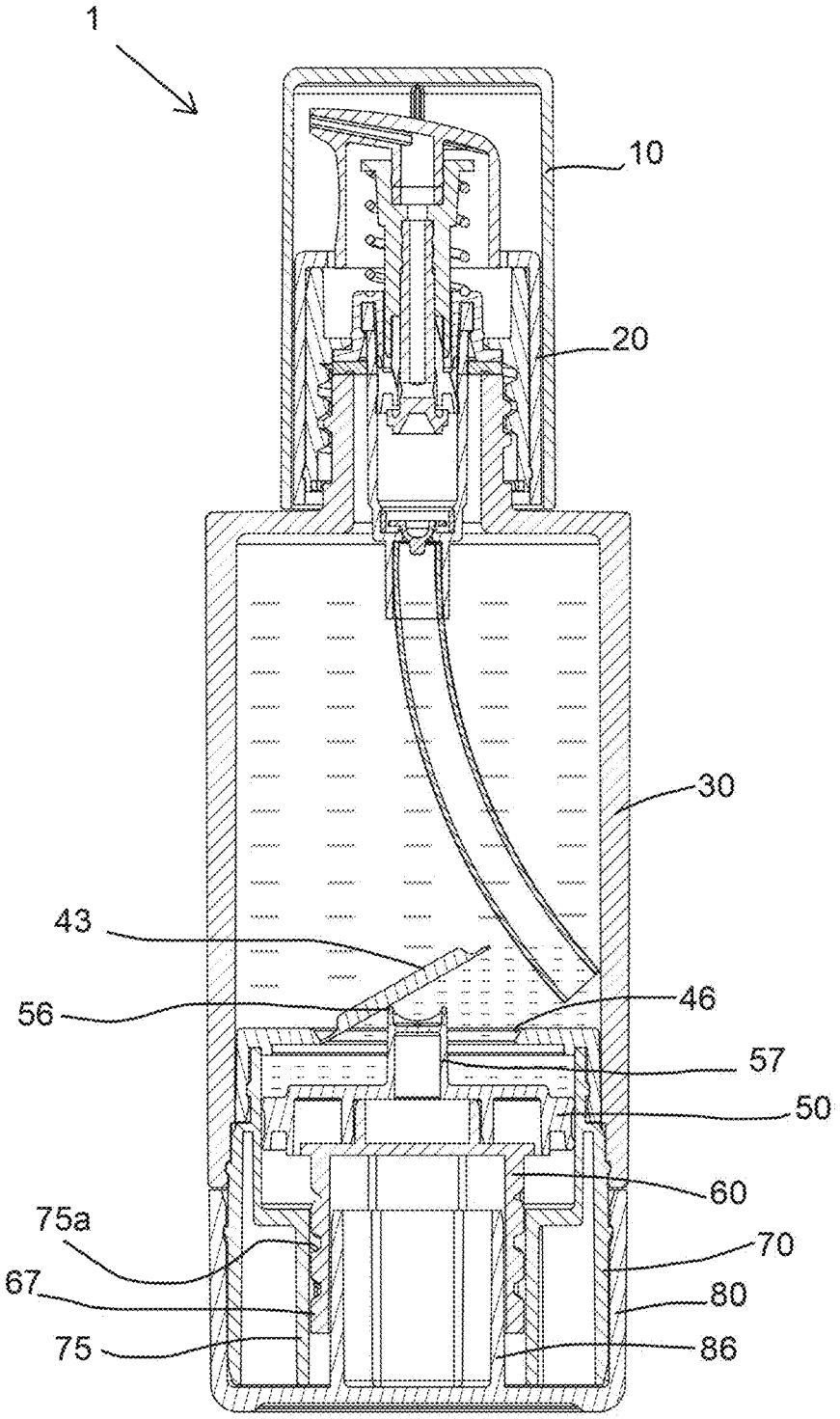
FIG. 14 illustrates another longitudinal cross-sectional of the cosmetic container of FIG. 2, after a dialer thereof is rotated for mixing a first product with a second product.
Figure 15:
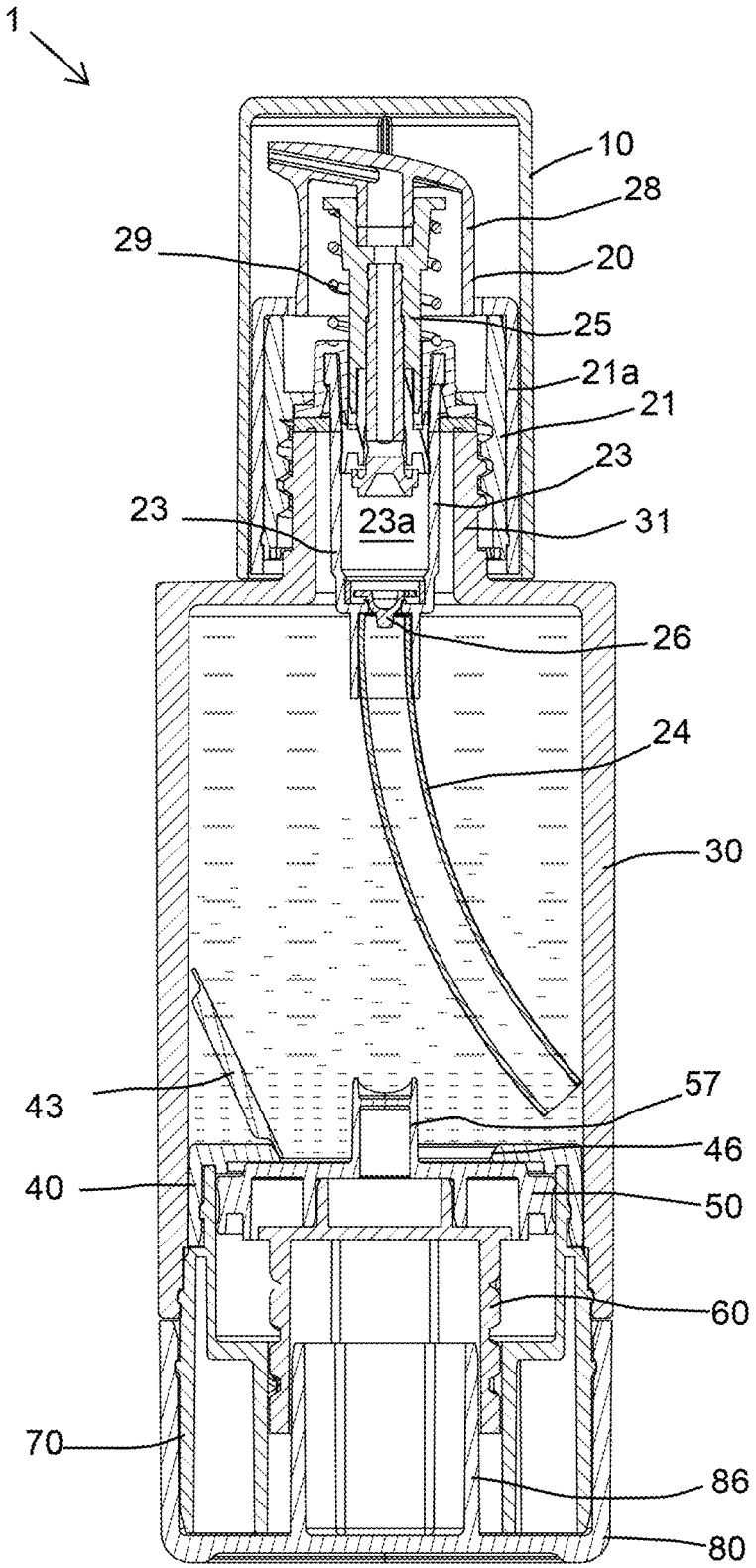
FIG. 15 illustrates another longitudinal cross-sectional of the cosmetic container of FIG. 2, showing the cosmetic container after all the second product is released into the first product container.

Next, the use of the cosmetic container 1 according to the present disclosure configured as described above and the effects thereof will be described with reference to FIGS. 2, 14, and 15.

Initially, prior to the first use of the cosmetic container 1 in line with this disclosure, as illustrated in FIG. 2, the first product P1 is housed within the first product container 30, while the second product P2 is stored within the second product container 70. Consequently, the first product P1 and the second product P2 remain segregated. To initiate the mixing of these two liquid products, P1 and P2, the user rotates the dialer 80 in relation to the first product container 30. This action results in the synchronous rotation of both the inner column 86 and the elevator 60, driven by the dialer 80. Given that the second product container 70 remains stationary relative to the first product container 30, the elevator 60, during its rotational motion, concurrently moves upward along the threads 75*a* of the second product container 70. As the elevator 60 ascends, it exerts upward pressure on the piston 50, compelling it to move in an upward direction. As the piston 50 rises, the central rod 57 of the piston 50 applies pressure, causing the rupture of the breakable region 43, thus creating an opening (aperture 46) within the seal cap 40, refer FIG. 14. This aperture 46 allows the second product P2 to flow into the first product container 30, facilitating its mixture with the first product P1. The piston 50 eventually reaches to its highest position, displacing the entire second product P2 from the reservoir cavity 32 into the first product container 30, and making contact with the inner surface of the seal cap 40, refer FIG. 15.

Thereafter, the user can then shake the cosmetic container 1 for uniformly mixing the first and second products P1, P2. When the user removes the outer cap 10 and presses the dispensing head 28 of the pump dispenser 20, the first product P1 and the second product P2 that were mixed inside the first product container 30 are discharged to the outside.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the invention. In addition, those skilled in the art may readily change or modifications to the disclosed embodiments, based on the present specification, such changes or modifications also belong to the scope of the present disclosure will be apparent.

What is claimed is:

1. A cosmetic container for mixing and discharging two fluid products, the cosmetic container comprises:

a first product contained in a first product container;

a second product stored in isolation from the first product within a reservoir cavity of a second product container, and the second product container attached to an open lower end of the first product container;

a seal cap covering an upper end of the second product container, the seal cap comprising a breakable region on a top wall of the seal cap;

a dialer for actuating a release of the second product into the first product container, the dialer configured to rotate around and enclose the second product container;

a pump dispenser affixed to a neck at an upper end of the first product container, the pump dispenser configured to discharge a mixture of the first product and the second product from the first product container to the outside of the cosmetic container;

a piston positioned within the reservoir cavity beneath the second product;

an elevator movably secured into a lower portion of the second product container, located beneath the piston in the second product container;

wherein both the first product and the second product are liquid products;

wherein a central rod is integrally formed on an upper side of the piston, the central rod includes a slanted upper edge;

wherein turning the dialer initiates a simultaneous upward and rotational movement of the elevator with respect to the second product container, the elevator in turn pushes the piston upward in the reservoir cavity;

wherein ascent of the piston within the reservoir cavity causes the slanted upper edge of the piston to separate the breakable region from the seal cap and create an aperture within the seal cap, further ascent of the piston expels the second product into the first product container;

wherein the second product container includes at least one reservoir sidewall defining the reservoir cavity, wherein an upper end of the at least one reservoir sidewall defines an open upper end of the second product container; wherein at a lower end of the reservoir cavity, the at least one reservoir sidewall includes a transversely extending annular ring wall, which serves to outline a lower boundary of the reservoir cavity; and wherein a cylindrical skirt extends downward in an axial direction from an inner edge of the annular ring wall;

wherein the second product container accommodates the elevator in a manner where the elevator seals a lower opening of the reservoir cavity; and wherein the elevator is threadedly engaged to the cylindrical skirt of the second product container by engaging two opposing inner threads, situated near an upper portion of the cylindrical skirt, with threads formed on an outer surface of the elevator; and wherein the breakable region is an area surrounded by an annular groove located on an upper surface of the top wall of the seal cap, the breakable region being separable from the rest of the top wall when subjected to sufficient pressure by the piston.

2. The cosmetic container according to claim 1, wherein the second product container further includes an outer sidewall located radially outwardly to the at least one reservoir sidewall; wherein an upper end of the outer sidewall is connected to the at least one reservoir sidewall by a transverse shoulder wall positioned at a middle portion of the at least one reservoir sidewall; and wherein a lower end of the outer sidewall defines an open lower end of the second product container.

3. The cosmetic container according to claim 1, wherein the two opposing inner threads of the second product container are protruded threads, while the threads on the elevator are grooved threads.

4. The cosmetic container according to claim 1, wherein the elevator comprises a transverse top wall and a lower cylindrical sidewall extending downwardly from a lower surface of the transverse top wall; wherein a connecting skirt extends upwardly from an upper surface of the transverse top wall; wherein threads are formed on an outer surface of the lower cylindrical sidewall of the elevator; and wherein the transverse top wall includes an annular flange that extends radially outwards as a radial extension of the transverse top wall.

5. The cosmetic container according to claim 4, wherein when the elevator is in a non-extended state, the annular flange of the transverse top wall of the elevator makes contact with the annular ring wall of the second product container; and wherein the connecting skirt of the elevator extends into the reservoir cavity of the second product container, and the lower cylindrical sidewall threadedly engages with an inner surface of the cylindrical skirt of the second product container through corresponding threads.

6. The cosmetic container according to claim 1, wherein the dialer includes a sidewall having an open upper end and a bottom end closed by a bottom wall; wherein the dialer further includes an inner column coaxially arranged with the dialer and integrally formed with the dialer; and wherein a receiving cavity is formed between the sidewall of the dialer and the inner column, the receiving cavity is configured to accommodate a lower portion of the second product container.

7. The cosmetic container according to claim 6, wherein the inner column of the dialer has a rectangular shape, characterized by two opposing flat sides and two opposing curved sides; and wherein a lower cylindrical sidewall of the elevator also has a rectangular internal cavity that is mounted over the inner column of the dialer to prevent any relative rotational movement between the elevator and the dialer during operation.

8. The cosmetic container according to claim 1, wherein the piston comprises a piston body and two piston lips, situated around the outer periphery of the piston body; wherein two piston lips are in leak-tight sliding contact with an inner surface of at least one reservoir sidewall of the second product container; and wherein the piston includes a connecting annular sleeve that extends downwards from the piston body and is configured to securely connect to a connecting skirt of the elevator.

9. The cosmetic container according to claim 6, wherein an inner surface of a cylindrical sidewall of the first product container includes a locking groove that receives a corresponding second locking protrusion formed on an outer surface of the second product container.

10. The cosmetic container according to claim 1, wherein an inner surface of a sidewall of the seal cap has an annular locking groove; and wherein the locking groove on the seal cap accommodates a corresponding first locking protrusion located on an outer surface of the at least one reservoir sidewall of the second product container, for coupling the seal cap to the second product container.

11. The cosmetic container according to claim 1, wherein an annular locking groove is formed at an inner surface of a sidewall of the dialer; wherein a third locking protrusion is formed at an outer surface of an outer sidewall of the second product container; and wherein the annular locking groove of the dialer receives the third locking protrusion of the second product container so that the dialer can rotate with respect to the second product container without being separated from the second product container.

12. The cosmetic container according to claim 1, wherein the pump dispenser has a support body threadedly mounted on the neck of the first product container; wherein the support body secures a pumping assembly to the neck of the first product container; wherein the pumping assembly includes a cylinder having a pressure chamber to temporarily store the first product or the mixture of the first product and the second product from the first product container; wherein the first product or the mixture of the first product and the second product is sucked in the pressure chamber through a suction tube; wherein the pumping assembly further includes a hollow piston rod, a lower end of the hollow piston rod is located in the cylinder and an upper end of the hollow piston rod passes through a central portion of the support body; wherein there is provided a check valve that opens and closes an inlet formed at a bottom of the cylinder; and wherein a dispensing head is fastened to an upper end of the hollow piston rod, and a discharge port formed on one side of the dispensing head; and wherein a coil spring is provided between the piston rod and the support body for elastically supporting the piston rod upward together with the dispensing head.

13. The cosmetic container according to claim 5, wherein the threads of the elevator are provided with at least one stopper protrusion at an upper end of the threads and at least one stopper protrusion at a lower end of the threads; wherein the at least one stopper protrusion at the upper end and the at least one stopper protrusion at the lower end define an upper movement limit and a lower movement limit of the elevator, respectively, corresponding to a fully extended position and a retracted position of the elevator; wherein when the threads of the second product container abut against the at least one stopper protrusion located at the upper end of the threads of the elevator, the elevator is prevented from ascending any further; and wherein when the threads of the second product container abut against the at least one stopper protrusion located at the lower end of the threads of the elevator, the elevator is prevented from descending any further.

14. A cosmetic container for mixing and discharging two fluid products, the cosmetic container comprises:

a first product contained in a first product container;

a second product contained within a reservoir cavity of a second product container, kept in isolation from the first product, and the second product container attached to an open lower end of the first product container;

a seal cap sealing an upper end of the second product container, the seal cap comprising a breakable region on an upper surface of the seal cap;

a dialer configured to actuate the mixing of the first product and the second product, the dialer enclosing a lower portion of the second product container and rotatably coupled to the second product container;

a piston positioned within the reservoir cavity beneath the second product;

an elevator movably secured into a lower portion of the second product container, located beneath the piston in the second product container;

wherein both the first product and the second product are liquid products;

wherein a central rod is integrally formed on an upper side of the piston as a single unit;

wherein rotating the dialer initiates a simultaneous upward and rotational movement of the elevator with respect to the second product container, the elevator in turn pushes the piston upward in the reservoir cavity;

wherein the second product container includes at least one reservoir sidewall defining the reservoir cavity, wherein at a lower end of the at least one reservoir cavity, the at least one reservoir sidewall includes a transversely extending annular ring wall and wherein a cylindrical skirt extends downward in an axial direction from the annular ring wall;

wherein the second product container accommodates the elevator in a manner where the elevator seals a lower opening of the reservoir cavity; and wherein the elevator is threadedly engaged to the cylindrical skirt of the second product container by engaging two opposing inner threads, situated near an upper portion of the cylindrical skirt, with threads formed on an outer surface of the elevator; and wherein ascent of the piston within the reservoir cavity causes the central rod of the piston to open the breakable region in the seal cap and create an aperture within the seal cap so that the second product can be released into the first product container.

15. The cosmetic container according to claim 14, wherein the cosmetic container includes a pump dispenser coupled to a neck at an upper end of the first product container, the pump dispenser discharges a mixture of the first product and the second product from the first product container to the outside of the cosmetic container.

16. The cosmetic container according to claim 15, wherein the piston comprises a piston body and two piston lips situated around the outer periphery of the piston body; wherein the two piston lips are in leak-tight sliding contact with an inner surface of a reservoir sidewall; wherein the piston includes a connecting annular sleeve that extends downwards from the piston body and is configured to securely connect to a connecting skirt of the elevator; wherein the central rod is coaxial with the piston body and extends upward from the piston body; and wherein the central rod of the piston includes a slanted upper edge that is configured to exert force on the breakable region causing the breakable region to separate from the remaining section of the seal cap.

17. A cosmetic container for mixing and discharging two fluid products, the cosmetic container comprises:

a first product contained in a first product container;

a second product contained within a reservoir cavity of a second product container, kept in isolation from the first product, and the second product container attached to an open lower end of the first product container;

a seal cap sealing an upper end of the second product container, the seal cap comprising a breakable region on an upper surface of the seal cap;

a dialer configured to actuate the mixing of the first product and the second product, the dialer enclosing a lower portion of the second product container and rotatably coupled to the second product container;

a piston positioned within the reservoir cavity beneath the second product;

an elevator movably secured into a lower portion of the second product container, located beneath the piston in the second product container;

wherein a central rod is integrally formed on an upper side of the piston;

wherein the piston includes a connecting annular sleeve that extends downwards from a piston body and is configured to securely connect to a connecting skirt of the elevator;

wherein the elevator includes threads on an outer surface of a sidewall of the elevator;

wherein rotating the dialer initiates a simultaneous upward and rotational movement of the elevator with respect to the second product container, the elevator in turn pushes the piston upward in the reservoir cavity;

wherein the dialer includes a sidewall having an open upper end and a bottom end closed by a bottom wall; wherein the dialer further includes an inner column coaxially arranged with the dialer and integrally formed with the dialer; wherein a receiving cavity is formed between the sidewall of the dialer and the inner column, the receiving cavity is configured to accommodate a lower portion of the second product container; and wherein the inner column of the dialer has a rectangular shape, characterized by two opposing flat sides and two opposing curved sides; and wherein a lower cylindrical sidewall of the elevator also has a rectangular internal cavity that is mounted over the inner column of the dialer to prevent any relative rotational movement between the elevator and the dialer during operation; and wherein ascent of the piston within the reservoir cavity causes the central rod of the piston to open the breakable region in the seal cap and create an aperture within the seal cap so that the second product can be released into the first product container.

* * * * *